United States Patent [19]

Bjella

[11] Patent Number: 4,819,452

[45] Date of Patent: Apr. 11, 1989

[54] METHOD OF MAKING RINGS

[76] Inventor: Russell Bjella, 10315 27th Avenue North, Plymouth, Minn. 55441

[21] Appl. No.: 120,474

[22] Filed: Nov. 13, 1987

[51] Int. Cl.[4] ..... A44C 9/00

[52] U.S. Cl. ..... 63/15; 29/160.6; 63/26

[58] Field of Search ..... 63/15, 26; 24/163 K; 29/160.6; 228/135; 40/21 A; 428/542.8

[56] References Cited

U.S. PATENT DOCUMENTS

| | | | |
|---|---|---|---|
| 331,086 | 11/1885 | Richmond . | |
| 499,926 | 6/1883 | Oppenheimer . | |
| 945,107 | 1/1910 | Moodey . | |
| 1,578,853 | 3/1926 | Schneiderman . | |
| 1,594,885 | 8/1926 | Kapla | 63/26 X |
| 1,842,427 | 1/1932 | Sammartino | 63/15 |
| 1,904,074 | 4/1933 | Peters | 63/26 X |
| 2,048,317 | 7/1936 | Berman . | |
| 2,119,229 | 5/1938 | Foster | 63/15 |
| 2,137,835 | 11/1938 | Dixon . | |
| 2,140,396 | 12/1938 | Whitaker . | |
| 2,302,696 | 11/1942 | Kartan | 63/15 |
| 2,537,449 | 1/1951 | Evenson . | |
| 2,763,140 | 9/1956 | Lutrario . | |
| 2,764,001 | 9/1956 | Lutrario . | |
| 2,840,875 | 7/1958 | Chambers | 24/163 K |
| 3,898,869 | 8/1975 | Reneer . | |
| 4,089,096 | 5/1978 | Michael . | |
| 4,118,948 | 10/1978 | Gralnik . | |
| 4,493,196 | 1/1985 | Bogner et al. | 63/15 |

*Primary Examiner*—James R. Brittain

*Attorney, Agent, or Firm*—Vidas & Arrett

[57] ABSTRACT

A finger ring with slotted design cavities for securely holding a design panel without the need for soldering or the like.

12 Claims, 1 Drawing Sheet

Fig.-1
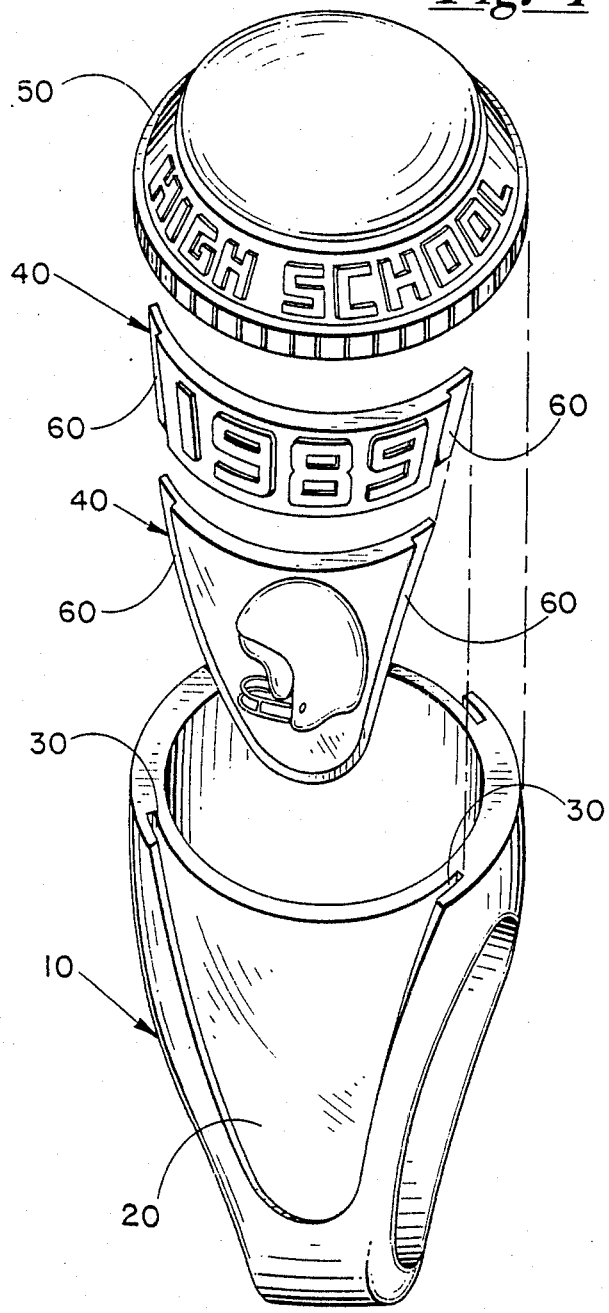
Fig.-3
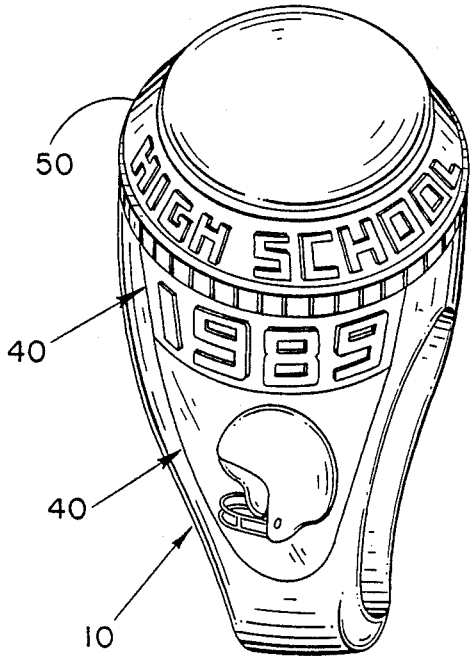
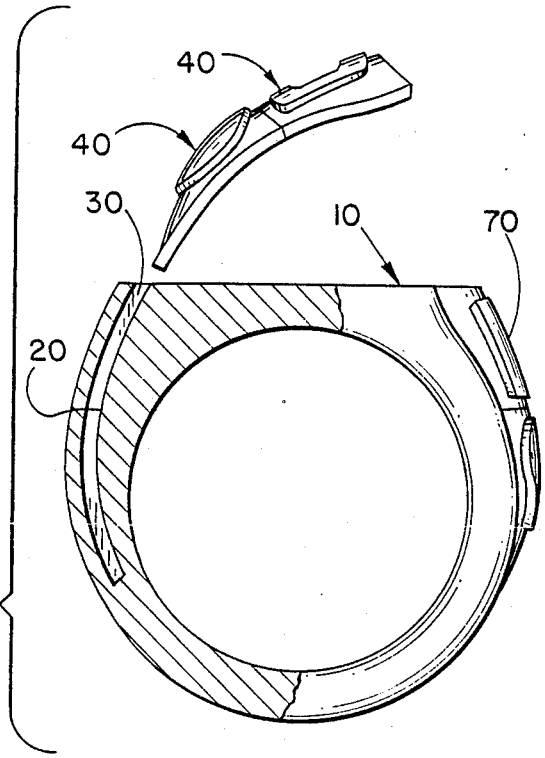
Fig.-2

METHOD OF MAKING RINGS

BACKGROUND OF THE INVENTION

1. Field of the Invention

This invention relates to a finger ring, and in particular to an improved method of securing design panels in a design cavity in the side of the ring.

2. Description of the Prior Art

Many of the prior art inventions cast the ring in one piece, including design panels. Each schools logo and year made it necessary to constantly make new molds. This was expensive since new molds were required for every new panel design. In an attempt to make the ring less expensive, design panels were cast separately and secured to the ring by a variety of means.

The conventional means of securing a design panel to a finger ring has been to put the design panel into a cavity in the side of the ring and then solder or fuse the design panel in place. Foster, U.S. Pat. No. 2,119,229 and Karlan, U.S. Pat. No. 2,302,696 utilize this means of security a design panel. Dixon, U.S. Pat. No. 2,137,835 puts the design panel on the edges of a cavity and then uses fingers which bend over to hold the design panel in place.

None of the prior art methods are satisfactory. Since a space must be left between the panel and the side of the cavity the panel may be soldered in crooked, which gives the entire ring a sloppy looking appearance. The panels may also simply fall out if the solder ever loosens or if the fingers loosen.

SUMMARY OF THE INVENTION

The present invention comprises a method of ring making which slides design panels into slotted cavities on a ring blank. It also includes devices made using the inventive method. The panels are designed to slide into these slots and are held in place by the bezel. The design panel may be in two or more pieces to facilitate flexible and economical design variations. The standardization of ring sizes and design panels will result in cheaper, automated manufacturing.

Other objects, advantages and distinctions of the present invention over the prior art will become apparent from the following description taken in conjunction with the accompanying drawings.

BRIEF DESCRIPTION OF THE DRAWINGS

The detailed description of the invention including its preferred embodiment is hereinafter described with specific references being made to the drawings in which:

FIG. 1 is a exploded view of a ring blank with a slotted design cavity, a two piece design panel and a bezel;

FIG. 2 is a cross-sectional view of a ring in accordance with FIG. 1 showing the slotted design cavity and design panel.

FIG. 3 is a perspective view of the components of FIG. 1 in place and secured to each other

DESCRIPTION OF THE PREFERRED EMBODIMENT

Referring to FIG. 1, a ring blank 10, two piece design panel 40 and bezel 50 are shown. The ring blank 50 contains design cavities 20 on one or both sides. The designing cavities are constructed and arranged to define slots 30. The design panel 40 may be one piece or multipiece. The preferred embodiment shown in FIG. 1 shows a two piece panel 40 having slot flanges 60 which are received by slots 30. The design panels 40 are held in place by slots 30 and bezel 50. Bezel 50 is attached to the ring by the usual methods which may include adhesives, soldering or the like. Although not required, design panel 40 may be soldered or glued in position.

Referring to FIG. 2, a cross-sectional view shows how the design panel 40 slides into the design cavity 20 and is held in place by slots 30. Reference numeral 70 indicates the position of a design panel 40 securely held by the interrelationship of slots 30 to slot flange 60.

When a ring is to be made, ring blanks and the design panels for the school and year are chosen. The design panels are slid from the bezel end of the ring blank into cavity 20. The flanges 60 are securely held to the walls of slot 30 of the ring blank. The bezel 13 then secured in place which prevents the panels from moving. This simple process allows each ring to be custom made with minimum time and ease. Also, the design panels may be made of different metals or other materials from the ring blank, creating an attractive, distinctive ring. The unique design allows the use of different materials since soldering is not required. Prior art methods did not allow the use of different materials because of soldering incompatibility.

It is to be understood that modification and variations may be made to the disclosed invention without departing from the spirit of the invention.

What I claim is:

1. A finger ring comprising:

(a) a preformed ring blank, said ring blank defining a closed substantially circular band of metal having an outer surface, said outer surface presenting a flattened surface and having at least one slotted design cavity intersecting said flattened surface and extending along a portion of the circumference of said outer surface with each said at least one slotted cavity defining an overlying flange;

(b) at least one design panel constructed and arranged to be slidably received within said at least one slotted design cavity; and (c) a bezel attached to the ring blank thereby securing the design panel.

2. The finger ring of claim 1 wherein each design panel comprises at least two pieces constructed and arranged to be received by said slotted design cavity.

3. The finger ring of claim 1 wherein said outer surface has at least two slotted design cavities, said slotted design cavities positioned similarly each on one side of said outer surface and extending a portion of the circumference of said outer surface.

4. The finger ring of claim 1 wherein said design panels are secured by soldering for additional strength and completely limit movement.

5. The finger ring of claim 2 wherein said design panels are secured by soldering for additional strength and completely limit movement.

6. The finger ring of claim 3 wherein said design panels are secured by soldering for additional strength and completely limit movement.

7. A method of constructing a finger ring comprising the steps of:

(a) making a ring blank, said ring blank defining a closed substantially circular band of metal having an outer surface, said outer surface presenting a flattened surface and having at least one slotted design cavity interacting said flattened surface and extending along a portion of the circumference of said outer surface with each said at least one slotted design cavity defining an overlying flange;

(b) making a design panel constructed and arranged to be received by said at least one slotted cavity;

(c) sliding said design panel into said at least one slotted design cavity; and (d) securing said design panel to the ring by attaching a bezel to the ring blank.

8. The method of constructing the finger ring of claim 7 further including the step of sliding another design panel into the slotted design cavity.

9. The method of constructing a finger ring as defined in claim 7 including the step of soldering said design panel to said finger ring for additional strength and to completely limit movement.

10. A method of constructing a finger ring comprising the steps of:

(a) Selecting a ring blank wherein said ring blank defines a closed substantially circular band of metal having an outer surface, said outer surface presenting a flattened surface and having at least one slotted design cavity intersecting said flattened surface and extending along a portion of the circumference of said outer surface with each said at least one slotted design cavity defining an overlying flange;

(b) Selecting a design panel constructed and arranged to be received by said at least one slotted design cavity;

(c) Sliding said design panel into said at least one slotted design cavity;

(d) Selecting a bezel; and (e) Securing said design panel to the ring by attaching the bezel to the ring blank.

11. The method of constructing the finger ring of claim 10 further including the step of sliding another design panel into another of said design cavities prior to attaching the bezel to the ring blank.

12. The method of constructing a finger ring as defined in claim 10 including the step of soldering said design panel in said at least one design cavity for additional strength and to completely limit movement.

* * * * *

UNITED STATES PATENT AND TRADEMARK OFFICE

CERTIFICATE OF CORRECTION

PATENT NO. : 4,819,452

DATED : April 11, 1989

INVENTOR(S) : Russell Bjella

It is certified that error appears in the above-identified patent and that said Letters Patent is hereby corrected as shown below:

Col. 3, line 1, delete "interacting" and insert

-- intersecting --.

Signed and Sealed this

Twenty-fourth Day of October, 1989

*Attest:*

DONALD J. QUIGG

*Attesting Officer*

*Commissioner of Patents and Trademarks*